United States Patent [19]

Levy

[11] 4,451,379

[45] May 29, 1984

[54] METHOD FOR CLEANING THE SURFACE OF SWIMMING POOLS

[76] Inventor: Richard Levy, P.O. Box 6313, Ft. Myers, Fla. 33906

[21] Appl. No.: 498,684

[22] Filed: Jun. 1, 1983

Related U.S. Application Data

[63] Continuation-in-part of Ser. No. 297,001, Aug. 27, 1981, abandoned.

[51] Int. Cl.[3] ..... C02F 1/52; C02F 1/54

[52] U.S. Cl. ..... 210/728; 210/169; 210/729

[58] Field of Search ..... 210/925, 712, 749, 776, 210/729, 704, 765, 169, 728, 416.4, 416.2; 422/43

[56] References Cited

U.S. PATENT DOCUMENTS

| | | | |
|---|---|---|---|
| 3,036,880 | 12/1962 | Malkemus | 422/43 |
| 3,085,850 | 4/1963 | Egan | 422/43 |
| 3,139,402 | 6/1964 | Armbrust | 210/712 |
| 3,415,614 | 12/1968 | Egan | 422/43 |
| 3,459,492 | 12/1962 | Cawley et al. | 422/43 |
| 3,577,340 | 8/1976 | Paviak et al. | 210/925 |
| 3,625,857 | 12/1971 | Weimer | 210/925 |
| 3,639,255 | 2/1972 | Boardman et al. | 210/925 |
| 3,810,835 | 5/1974 | Ferm | 210/925 |
| 3,817,387 | 6/1974 | Arneson | 210/169 |
| 3,959,134 | 5/1976 | Canevari | 210/925 |
| 3,988,932 | 11/1976 | Baier et al. | 210/925 |
| 4,098,694 | 4/1978 | Perlay | 210/925 |
| 4,110,213 | 8/1978 | Tennant | 210/925 |
| 4,160,033 | 7/1979 | Garret et al. | 424/285 |
| 4,197,197 | 4/1980 | Abaeva et al. | 210/925 |
| 4,198,720 | 4/1980 | Matsumoto | 15/1.7 |

OTHER PUBLICATIONS

Garrett & Barger, "Factors Affecting the Use of Monomolecular Surface Films to Control Oil Pollution on Water", Environmental Science & Technology, vol. 4, Feb. 1970, pp. 123–127.

"The Atlas HLB System", Atlas Chemical Industries Inc., (4th Printing), 1963.

*Primary Examiner*—Peter A. Hruskoci
*Assistant Examiner*—Sharon T. Cohen
*Attorney, Agent, or Firm*—Dority & Flint

[57] ABSTRACT

A method for removing leaves, pieces of bark, surface scum and debris from a swimming pool, fountain or other impounded body of water comprises forming on the surface of the water in the pool an approximately monomolecular film of a nonionic autophobic liquid organic material having an HLB number of 10 of less, a boiling point of 170° C. or higher and a bulk viscosity less than 1000 centistokes under conditions of use, which film pushes leaves, solids, semisolids, surface scum and debris to a preselected region of the pool, fountain or impounded body of water and compacts the foreign matter for easy removal.

12 Claims, 2 Drawing Figures

METHOD FOR CLEANING THE SURFACE OF SWIMMING POOLS

This application is a continuation-in-part of application Ser. No. 297,001 filed on Aug. 27, 1981, now abandoned entitled "Method for Cleaning the Surface of Swimming Pools."

FIELD OF THE INVENTION

This invention relates to a facile method for removing scum and debris from the surface of a swimming pool or similar enclosed body of water.

BACKGROUND OF THE INVENTION

The problem of removing floating debris and scum from enclosed bodies of water such as swimming pools or fountains has traditionally been addressed by sifting and/or "vacuuming" the surface of the body of water. However, this approach is generally unsatisfactory owing to inability of the worker performing the pool cleaning operation to reach all portions of the pool with the cleaning tool and to continuous movement and/or redispersal of the flotsam and debris during the cleaning routine.

Accordingly, it would facilitate and speed up routine pool cleaning operations if the scum and debris could be directed to one area of the pool or impounded body of water, such as to the region of the skimmer built into the body of water, and compacted prior to use of the vacuum cleaner or other traditional suction apparatus or sifting device to remove the debris from the surface of the water.

Canevari has proposed, in U.S. Pat. No. 3,959,134 the use of an oil collection agent to contain and reduce the volume of oil slicks, prior to removal of the oil from the surface of the water. Oil collection agents disclosed in the Canevari patent include $C_{10-20}$ aliphatic monocarboxylic acids and the corresponding sorbitan monoesters, which are applied from a solvent system including an isoparaffinic solvent and a glycol ether. The solvent system was selected to effect dispersion of the oil collection agent by duplex film spreading, rather than by autophobic spreading, and thereby achieve higher spreading pressures than obtainable from a surfactant spreading as a monolayer by the autophobic mechanism.

U.S. Pat. No. 3,988,932 granted to Robert E. Baier et al discloses a method and apparatus for taking a sample of oil from a large body of water such as an ocean. A very small amount of surfactant (so small that its weight is undetectable, col. 1, line 48) is used to compress an oil slick so that a small sample of the oil can be removed without contamination of the oil slick or adversely affecting a subsequent analysis of the oil sample.

The use of oxyethylated alcohols or phenols, containing varying numbers of oxyethylene units, to disperse oil slicks, rather than collect the oil therein, has been proposed by Paviak et al. (U.S. Pat. No. 3,577,340), Weimer et al. (U.S. Pat. No. 3,625,857) and Boardman et al. (U.S. Pat. No. 3,639,255).

The application of a monolayer or thin film of material to the surface of a body of water is a well known technique for preventing undue evaporation. Materials used include monoglycerides of 18–24 carbon fatty acids and mixtures thereof with long chain primary alkanols, as proposed by Cawley et al. (U.S. Pat. No. 3,459,492); glycol monoesters of 14–22 carbon fatty acids, as proposed by Malkemus (U.S. Pat. No. 3,036,880); and myristyl, cetyl and stearyl alcohols, as proposed by Egan (U.S. Pat. Nos. 3,085,850 and 3,415,614). Application from solvent systems is contemplated, including diethyl ether, n-hexane, kerosene and butanol by Crawley, et al.; benzene, heptane, methyl isobutyl ketone, methyl ethyl ketone, butyl acetate and butyl alcohol by Malkemus, and 6–10 carbon alcohols, furfuryl alcohol, furan and tetrahydrofuran by Egan.

Garrett et al. have proposed (U.S. Pat. No. 4,160,033) application of a monomolecular or duplex film of an organic material, by an autophobic spreading mechanism, to kill mosquito larvae in ponds in natural paludal settings. The organic materials recited by Garrett et al. include sorbitan monooleate and oxyethylated saturated and unsaturated alkanols.

It will be appreciated that although a variety of approaches to formation of monomolecular or thin films on the surface of bodies of water have been disclosed, there is as yet no satisfactory method of concentrating scum and debris on the surface of enclosed bodies of water, prior to mechanical removal of the compacted scum and debris, relying on the autophobic spreading of the monolayer to direct the scum and debris to a segregated portion of the water surface.

OBJECT OF THE INVENTION

It is an object of this invention to provide a method for removal of solids, semi-solids and scum-like surface debris from swimming pools or other enclosed bodies of water, using autophobic spreading of an organic material to translocate and compact the scum and debris into a limited area of the pool and thereby facilitate removal of the compacted solid matter. The solid debris normally includes leaves, pieces of bark, etc. that frequently fall into swimming pools, hot tubs, etc.

SUMMARY OF THE INVENTION

This invention relates to a method for removing leaves, pieces of bark, surface scum, and debris from a swimming pool, fountain or impounded body of water, comprising forming on the surface of the water in the pool an approximately monomolecular film of a nonionic autophobic liquid organic material having an HLB number of 10 or less, a boiling point of 170° C. or higher and a bulk viscosity less than 1000 centistokes under conditions of use, which film pushes the leaves, surface scum, and debris to a preselected region of the pool, fountain or impounded body of water and compacts the foreign matter so that it can readily be removed from the pool.

DETAILED DESCRIPTION

Figure 1:
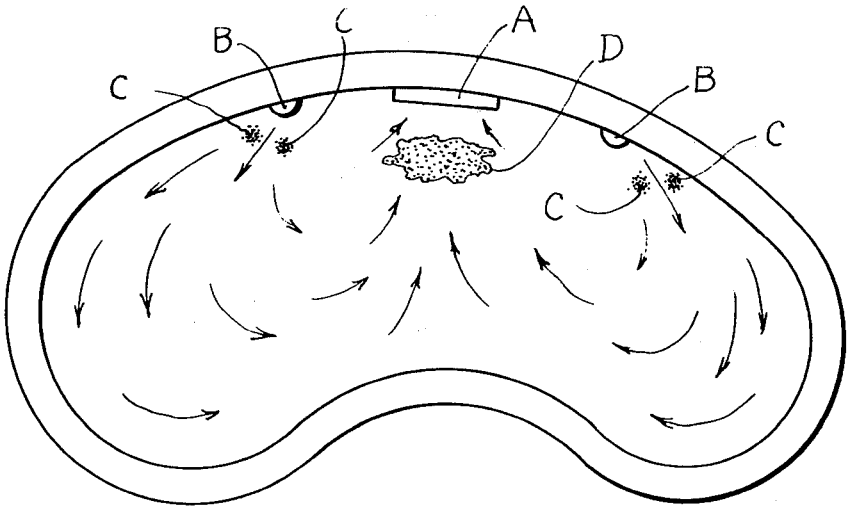
In FIG. 1 is shown the practice of the invention in a pool provided with a suction skimmer.

Autophobic spreading behavior is as described by Canevari and Garrett et al., supra, herein incorporated by reference. Autophobic materials will not spread over themselves, but remain as a "lens" on the surface of the water being treated. A monolayer is formed as material emanates from the lens and pushes scum and debris ahead of it.

The autophobic liquid organic materials used in the practice of this invention are liquids under ambient conditions, boil above about 170° C. and have an HLB number of 10 or less. HLB means "Hydrophile-Lipophile Balance," as defined in "The ATLAS HLB SYSTEM," Atlas Chemical Industries, Inc. (4th Printing) 1963. The HLB number is an indication of the percentage of the hydrophilic portion of the non-ionic emulsifier molecule, as defined at pages 3 and 18 of this reference.

It will be understood that the terms "ethoxylated" and "oxyethylated" are used interchangeably and refer to reaction products obtained from, for example, an alcohol, and ethylene oxide. These materials are accordingly of the formula: $RO(CH_2CH_2O)_nH$ in which R represents an alkyl isoalkyl or alkenyl group of a specified number carbons and n is the number of oxyethylene groups. For example, diethylene glycol monooleyl ether can be represented by the formula: $C_{18}H_{35}O(CH_2CH_2)_2H$ and oxyethylated laurl alcohol having four oxyethylene groups by the formula:

$$C_{12}H_{25}O(CH_2CH_2O)_4H$$

For ease of application, the autophobic organic liquids will have a viscosity below about 1000 centistokes at the time of application.

Autophobic organic liquids contemplated for the practice of this invention include, but are not limited to:

(a) an oxyethylated branched alkanol of 15–19 carbon atoms or unsaturated cis-alkanol of 12–18 carbon atoms and up to five oxyethylene groups;
(b) an unsaturated cis-alkanol of 15–19 carbon atoms;
(c) diethylene glycol monolaurate;
(d) oxyethylated lauryl alcohol having four oxyethylene groups and
(e) sorbitan monooleate.

It will be understood that mixtures of the foregoing can also be used in the method of this invention. The autophobic organic materials applied to the surface of a body of water in accordance with this invention can be used undiluted, i.e., neat, or admixed with up to 30% by volume of isopropanol.

Preferred materials are:

(a) sorbitan monooleate
(b) 75% by volume sorbitan monooleate and 25% by volume isopropanol
(c) diethylene glycol monoisostearyl ether
(d) diethylene glycol monooleyl ether
(e) oxyethylated lauryl alcohol having 4 oxyethylene groups
(f) diethylene glycol monolaurate
(g) oleyl alcohol Most preferred compounds are diethylene glycol monoisostearyl ether, diethylene glycol monooleyl ether and oleyl alcohol. These materials have low toxicity and are less irritating than some of the other materials employed. Moreover, these materials are readily degradable.

In the practice of the invention, the autophobic organic material is applied to the surface, at a chosen point, of the pool being treated. This is conveniently done near the corner or side of the pool by adding a few drops of the autophobic material with a standard eye dropper into the water. One drop of most preferred compounds designated (c), (d), or (g) is about 0.025 ml. or 25 μl.

As the autophobic approximately monomolecular film is generated, in a fashion essentially concentrically from the point of application, the leaves, pieces of bark, and other scum and debris are collected and pushed ahead of the film, ultimately being compacted at a distant preselected part of the pool. The compacted material is then readily collected by vacuuming and/or sifting to afford a sparkling clean water surface, with much less effort required on the part of pool attendants than heretofore.

A recommended technique for practicting this invention is shown in FIG. 1. The autophobic material is added to the surface of the water in the pool being treated in front (C) of the circulating pump directional jet outlets (B). The autophobic material will spread out laterally, as shown by the arrows, pushing the solids, semisolids, and compacted scum and debris (D) along with the directional flow of water from the water jet ports (B) toward the suction skimmer (A), which removes the scum and debris from the pool. It should be noted that this technique will only be efficient when the level of the water in the pool is not above or below the skimmer port.

An alternate mode of application would be in portions along the end of the upwind end of the pool, so that the scum and debris will travel ahead of the monomolecular autophobic film and be compacted at the downwind end of the pool for easy collection therefrom.

Typically, the amount of autophobic material required to produce an approximately monomolecular layer for the process is of the order of 2–10 microliters per square meter ($\mu l/m^2$) of pool surface; however, higher dosages (i.e. 20 $\mu l/m^2$) may be required depending on water surface characteristics, environmental-meteorological conditions, and the system used for debris removal. Therefore, a back yard pool 20×30 feet (55.7 square meters) will usually require an application of 111.4–557 microliters of organic material, whereas a 30×75 foot (209 $m^2$) pool will usually require 418–2090 microliters of autophobic material. Reapplication at these dosage rates may be required under adverse conditions.

Figure 2:
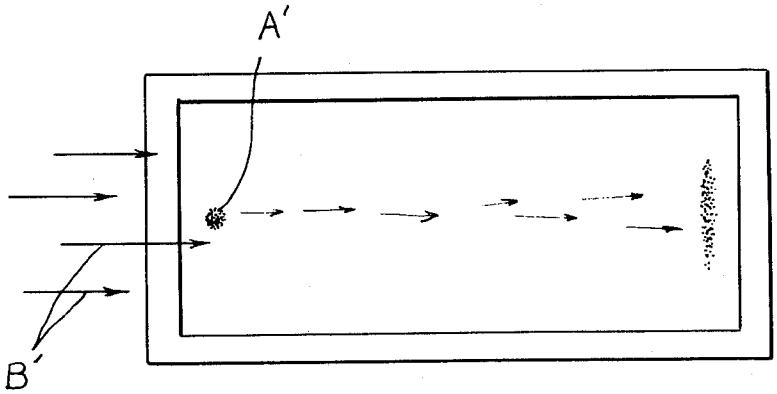
In FIG. 2 is shown the practice of the invention, in which the treating material is at least partially distributed by the wind.

Under ideal laboratory conditions (i.e. under conditions of no surface debris, wind or pumping), the autophobic material will spread over the surface of the water at a rate of the order of 10 cm/sec for the first 100 cm. Based on data presented by Garrett and Barger in "Environmental Science & Technology" (1970), it was determined that under these conditions, oxyethylated isostearyl alcohol having two ethoxy groups will travel down the length of a 20×30 foot pool, in approximately 2.3 minutes and that of a 30×75 foot pool in approximately 6.5 minutes. Although the spreading velocity will vary depending on the autophobic material used, their rates of movement under ideal conditions will be similar. Under practical operational conditions, the rate of movement of the autophobic material will be a function of wind and/or circulating pump velocity and the concentration of floating scum and debris. That is, the rate of movement will be significantly increased when added to a pool in upwind locations and in outlet areas of the pump jets. Movement of material will be decreased as a function of the amount of surface scum and debris and the distance to be moved. For example, if oxyethylated isostearyl alcohol having two ethoxy groups was added to the upwind short side of a 30×75 foot pool subjected to a 10 mph directional wind, it would reach the far side in ca. 1.6 minutes in the absence of surface debris. This is shown in FIG. 2, in which the autophobic material is applied at the end of a 30×75 foot pool at A', subjected to wind of 10 mph in the direction indicated by B'.

Removal of compacted debris and scum through the suction skimmer port built into the side of a pool will be a preferred mode of practicing the invention. The circulation of water from the circulating pump jets toward the suction skimmer port or ports and thence to the pool filter helps to remove surface debris. The pump causing circulation may operate continuously or be operated 8–12 hours a day. Use of the composition described above results is considerably more efficient removal of scum and debris than heretofore. However, other cleaning devices, such as the commonly-used "pool skimming net" can be used. This device is essentially a sifter which comprises a mesh net, often of nylon, affixed to a long pole. The pool attendant passes the net portion through the water to manually skim off the solid debris.

Without further elaboration, it is believed that one skilled in the art can, using the preceding description, utilize the present invention to its fullest extent. The following specific embodiments are, therefore, to be construed as merely illustrative and not limitative of the remainder of the disclosure in any way whatsoever. In the following Examples, the temperatures are set forth uncorrected in degrees Celsius. Unless otherwise indicated, all parts and percentages are by volume.

EXAMPLE 1

Laboratory experiments to demonstrate compacting of scum on the surface of the water were conducted in flat rectangular containers (ca. 0.05 $m^2$ of surface), partly filled with water (26° C.), the surface of which was sprinkled with talc.

Application of one drop of diethylene glycol monolaurate with a microsyringe (ca. 1.2 μl) at one corner of the container caused displacement of the talc to the opposite corner, from which the compacted talc was readily removed with a pipette.

Similar results were obtained using 75% sorbitan monooleate and 25% isopropanol, diethylene glycol monoisostearyl ether, oxyethylated lauryl alcohol having four oxyethylene groups, sorbitan monooleate, oleyl alcohol and diethylene glycol monooleyl ether.

EXAMPLE 2

Six drops (ca. 150 μl) of diethylene glycol monoisostearyl ether were applied with a glass eye dropper in portions near the upwind end of a 15×30 foot (41.8 $m^2$) rectangular swimming pool having a water temperature of ca. 24° C. The scum and debris were thereupon displaced to and compacted at the downwind end of the pool, from which it was readily removed with a conventional pool skimming tool.

EXAMPLE 3

Four drops (ca. 100 μl) of diethylene glycol monooleyl ether were applied with a plastic dispensing bottle into the circulating pump jet streams of a 17×30 foot (ca. 41.8 $m^2$) kidney-shaped pool, i.e. 2 drops were applied on the water surface in front of each of the two pump jet outlet ports, shown as B in FIG. 1. This procedure allowed the autophobic material to spread out and push skum, dirt particles, and floating insects with the directional water flow into the skimmer (A) where the autophobic material and surface scum and debris were rapidly removed from the pool leaving a crystal clear pool surface. Similar results were obtained with diethylene glycol monoisostearyl ether under these conditions.

EXAMPLE 4

Similar demonstrations indicating effective translocation and directional compaction of surface scum and debris at recommended dosages were conducted under natural conditions in impounded bodies of water such as concrete pumping station bunkers, and settling, polishing, and evapo-percolation ponds of sewage treatment systems, roadside ditches, and natural paludal ponds. Tests were conducted with 75% sorbitan monooleate and 25% isopropanol, diethylene glycol monoisostearyl ether and diethylene glycol monooleyl ether.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modification of the invention to adapt it to various usages and conditions.

What is claimed is:

1. A method for cleaning leaves, pieces of bark, and other solid, semi-solid debris and scum from a swimming pool, filled with water comprising forming on the surface of the water in the pool an approximately monomolecular film of a nonionic autophobic liquid organic material having an HLB number of 10 or less, a boiling point of 170° C. or higher, bulk viscosity less than 1000 centistokes under conditions or use by applying the organic material at a level of 2–20 μl/$m^2$ of water surface, which monomolecular film pushes the surface scum and debris to a preselected region of the pool of water and compacts the suurface scum and debris, and removing the thus-compacted surface scum and debris with a compacted scum and debris removal device positioned at a remote end of the pool from where said autophobic material is place in said pool.

2. The method of claim 1, wherein the autophobic organic material is dissolved in isopropanol in an amount up to 30% by volume of the total of solvent and autophobic organic material.

3. The method of claim 1, wherein the autophobic organic material is sorbitan monooleate.

4. The method of claim 1, wherein the autophobic organic material is an oxyethylated branched alkanol of 15–19 carbon atoms or unsaturated cis-alkanol of 12–18 carbon atoms and up to five oxyethylene groups.

5. The method of claim 4, wherein the autophobic organic material is oxyethylated isostearyl alcohol having two ethoxy groups.

6. The method of claim 4, wherein the autophobic organic material is oxyethylated oleyl alcohol having two oxyethylene groups.

7. The method of claim 1, wherein the autophobic organic material is an unsaturated cis-alkanol of 15–19 carbon atoms.

8. The method of claim 1, wherein the autophobic organic material is diethylene glycol monolaurate.

9. The method of claim 1, wherein the autophobic organic material is oxyethylated lauryl alcohol having four oxyethylene groups.

10. The method of claim 1, wherein a swimming pool having a water circulation system and at least one suction skimmer port is being cleaned, and wherein the autophobic organic material is applied near circulating pump jets and compacted scum and debris is removed by the suction skimmer port.

11. The method of claim 1, wherein the compacted surface scum and debris is removed with a pool skimming net operated by a pool attendant.

12. The method of claim 1, wherein autophobic organic liquid is added at a level of 2–10 $\mu l/m^2$ of water surface.

* * * * *